US010196162B2

(12) United States Patent
Rasi

(10) Patent No.: US 10,196,162 B2
(45) Date of Patent: Feb. 5, 2019

(54) APPARATUS FOR PACKAGING BATCHES OF PRODUCTS PACKED IN CARTONS OR IN WRAPPING FILM

(71) Applicant: TISSUE MACHINERY COMPANY S.p.A., Bologna (IT)

(72) Inventor: Michele Rasi, Ferrara (IT)

(73) Assignee: TISSUE MACHINERY COMPANY S.p.A., Bologna (IT)

( * ) Notice: Subject to any disclaimer, the term of this patent is extended or adjusted under 35 U.S.C. 154(b) by 735 days.

(21) Appl. No.: 14/711,177

(22) Filed: May 13, 2015

(65) Prior Publication Data

US 2015/0329230 A1 Nov. 19, 2015

(30) Foreign Application Priority Data

May 14, 2014 (IT) ..... BO2014A0288

(51) Int. Cl.
*B65B 59/00* (2006.01)
*B65B 39/02* (2006.01)
(Continued)

(52) U.S. Cl.
CPC ..... *B65B 39/02* (2013.01); *B65B 5/06* (2013.01); *B65B 9/10* (2013.01); *B65B 25/146* (2013.01);
(Continued)

(58) Field of Classification Search
CPC ..... B65B 25/146; B65B 35/40; B65B 39/007; B65B 39/02; B65B 59/00; B65B 39/12;
(Continued)

(56) References Cited

U.S. PATENT DOCUMENTS 4,679,379 A 7/1987 Cassoli
6,067,780 A * 5/2000 Gentili ..... B65B 11/22 53/230
(Continued)

FOREIGN PATENT DOCUMENTS

EP 1 801 012 A1 6/2007
WO 2007/088567 A1 8/2007

OTHER PUBLICATIONS

Search Report for corresponding Italian Patent Application No. BO2014A000288 dated Sep. 2, 2014.

*Primary Examiner* — Michelle Lopez
*Assistant Examiner* — Chinyere Rushing-Tucker
(74) *Attorney, Agent, or Firm* — Renner, Otto, Boisselle, & Sklar LLP

(57) ABSTRACT

An apparatus for wrapping batches of products for insertion into a carton includes a lifter for lifting a batch from a first height to a second height at which a pusher pushes the batch into a tunnel toward a loading zone along a direction of movement, a station for feeding wrapping film to a folder that supports and guides the film around the tunnel; a longitudinal sealer configured to join two longitudinal flaps of the film to form a tubular shape; a transverse sealer positioned close to a rear end of the tunnel for joining the top and bottom flaps of the tubular film; and a pair of panels for containing/retaining the batch coming out from the tunnel; the panels being slideable along respective side walls of the tunnel to modify the operating length of the tunnel.

11 Claims, 5 Drawing Sheets

(51) Int. Cl.

| | |
|---|---|
| ***B65B 9/10*** | (2006.01) |
| ***B65B 5/06*** | (2006.01) |
| ***B65B 25/14*** | (2006.01) |
| ***B65B 35/40*** | (2006.01) |
| ***B65B 39/00*** | (2006.01) |
| ***B65B 39/12*** | (2006.01) |
| ***B65B 43/52*** | (2006.01) |
| ***B65B 57/14*** | (2006.01) |
| ***B65B 59/02*** | (2006.01) |

(52) U.S. Cl.
CPC ..... *B65B 35/40* (2013.01); *B65B 39/007* (2013.01); *B65B 39/12* (2013.01); *B65B 43/52* (2013.01); *B65B 57/14* (2013.01); *B65B 59/00* (2013.01); *B65B 59/02* (2013.01); *B65B 2220/16* (2013.01); *B65B 2220/18* (2013.01)

(58) Field of Classification Search
CPC ..... B65B 43/52; B65B 57/14; B65B 59/02; B65B 9/10; B65B 5/06
USPC ..... 53/443, 147
See application file for complete search history.

(56) References Cited

U.S. PATENT DOCUMENTS

| | | | | |
|---|---|---|---|---|
| 2002/0059779 | A1* | 5/2002 | Gamberini | B65B 11/22 53/228 |
| 2002/0059785 | A1* | 5/2002 | Gamberini | B65B 11/10 53/543 |
| 2004/0016213 | A1* | 1/2004 | Loperfido | B65B 25/146 53/461 |
| 2007/0125242 | A1* | 6/2007 | Dall'Omo | B65B 25/146 99/450.4 |
| 2007/0137145 | A1* | 6/2007 | Dall'Omo | B65B 25/143 53/452 |
| 2009/0113849 | A1* | 5/2009 | Giuliani | B65B 9/067 53/446 |
| 2009/0120045 | A1* | 5/2009 | Gorrieri | B65B 11/12 53/543 |
| 2009/0139185 | A1* | 6/2009 | Gorrieri | B65B 11/42 53/251 |
| 2012/0205272 | A1 | 8/2012 | Heilman et al. | |

* cited by examiner

APPARATUS FOR PACKAGING BATCHES OF PRODUCTS PACKED IN CARTONS OR IN WRAPPING FILM

This application claims priority of Italian Application No. BO2014A000288 filed May 14, 2014, which is hereby incorporated herein by reference.

BACKGROUND OF THE INVENTION

This invention relates to an apparatus for packaging batches of products packed in cartons or in wrapping film.

In this description, particular reference is made to rolls of products such as rolls of toilet paper or kitchen paper, without thereby limiting the scope of protection to other products (for example, boxes of facial products—cartons containing folded cellulose clips—bags of nappies—diapers—or other products already wrapped in a package and then grouped together in batches).

Batches (or collections) of products mean a predetermined number of individual packs closed and grouped together in a batch; each closed pack comprises a predetermined number of products which may vary depending on requirements (for example, in rolls, packs of four, six eight rolls, etc.).

In other words, a batch of products is the sum of a predetermined number of closed packs of products.

At present there are two main apparatuses used for packaging the above-mentioned batches of products: a bagging apparatus configured for bagging the batches of products in tubular wrappers made of film defined automatically by the apparatus on the batches of products to be packaged, or an apparatus for packaging batches of products in cartons with standardised dimensions; both the types of packs are used by the large-scale distributors.

With regard to the bagging apparatus, it comprises:

- means of grouping together individual closed packs, arriving from a feed station, into a batch of predetermined dimensions to be placed on:
- a surface for receiving and sliding batches of products (the individual products of which, if in a roll, have the longitudinal axis of the core vertical or transversal to the feed surface) also comprising a tunnel formed by a frame with quadrangular cross section;
- a reel for feeding to the frame a flat strip of wrapping film material (in particular film of heat-sealable material which may be typically LDPE or HDPE);
- a means for pushing batches of products along the tunnel and along a direction of movement;
- folding means supported by the frame and configured for folding on itself a flat strip of film, in such a way as to generate a tubular shape, supported by the inner part of the tunnel, and having longitudinal flaps positioned next to and superposed on each other on the upper part of the tunnel;
- first means for sealing longitudinal superposed flaps of film, facing the above-mentioned longitudinal flaps, and configured to close the tubular wrapper longitudinally.
- second means for sealing the top and bottom of the wrapper being formed, positioned at the downstream end of the frame (relative to the feed direction), and oriented transversely to the tubular shape, in such a way as to seal the wrapper, transversally, so as to form, in sequence, a closed front end, before or at the same time as the arrival of the batch of products, and a closed rear end after the complete exit of the batch of products from the tunnel.

The apparatus structured in this way packages groups of products with wrapping film using at least the following steps:

- grouping together a series of packs of products to form a batch of products which can be wrapped in the closed tube of film;
- preparing the batch of products on the receiving surface and in proximity to the pushing element;
- forming the wrapping with the film around the above-mentioned folding means and the walls of the tunnel;
- sealing the top of the wrapping film at the final end of the tunnel;
- introducing the batch of products into the tunnel by the horizontal pushing of the pushing element along the same surface and inside the tunnel until the top products come into contact with the front closing end of the wrapper;
- further feeding of the groups of products beyond the above-mentioned sealing means, with simultaneous feeding of the film from the reel thanks to the pushing of the products, and relative forming of the wrapping, as the front closed end of the film and the batch of products moves forward beyond the tunnel;
- at the same time as forming the wrapping, longitudinal sealing of the above-mentioned superposed flaps of film using the above-mentioned first sealing elements;
- further activation of the second transversal sealing elements so as to close the wrapping behind (to the rear) of the batch already bagged;
- separating cut of the bag thus obtained from the rest of the film, using cutting means, thus starting a new and subsequent cycle for bagging the batches of products.

With regard to the apparatus for packaging batches of products in cartons with standardised dimensions, this apparatus uses a type of carton formed, usually but without limiting the scope of the invention, by four closed side walls and two walls, top and bottom, each equipped with one or two pairs of flaps which can be folded for opening and closing the top and bottom walls.

These apparatuses comprise basically two operating islands: one for preparing and feeding batches of products and the other for handling and preparing the individual cartons, which are positioned at the other operating island in such a way as to receive the groups of products thanks to the position of the carton conveniently open at the top and bottom walls.

More specifically, the island for preparation of the cartons comprises:

- a system for storage of the cartons stacked on top of each other, that is, a stack of cartons folded on each other;
- gripping elements (for example belts) for picking up the individual cartons and feeding them along a feed trajectory;
- a unit for lifting or "erecting" the carton positioned along the feed trajectory and, using contrast elements and suction elements, makes it possible to put the carton into shape; this unit, after opening the carton, translates the carton and positions it in a loading zone or station.

The above-mentioned operating island for preparing and feeding products comprises:

- a station for feeding the individual closed packs along a first direction of movement (normally transversal to the trajectory for feeding the cartons); it should be noted that the individual products (if in a roll) inside the individual packs have, in this case, the axis of the central core horizontal or parallel to the first direction of movement.

means of grouping together the closed packs in a batch of predetermined dimensions to be placed on a lifting surface positioned downstream of the feeding station, relative to the direction of movement, and at a first height for receiving batches; the lifting surface is configured for moving between the first receiving height and a second height for introducing batches (normally higher than the first with respect to a reference surface on the ground);

an element for pushing the batch of products, positioned at the second height for introducing the batch of products, and configured for moving parallel to the first direction of movement between a non-operating retracted position and an advanced operating position for pushing and housing the batch of products inside the carton;

a fixed connecting surface is positioned, in a coplanar fashion, between the lifting surface and the open top wall of the carton to allow the sliding of the batch of products from the lifting surface to the carton.

It should be noted that between the downstream end of the connecting surface and the carton there is a distance at least equal to the length of the flaps (open) of the top wall (this size is always calibrated for the maximum permitted size of the flaps present on the cartons).

In light of this, the connecting surface has a pair of flaps projecting from the downstream end.

Each wing can be rotated between a position close to the connecting surface and a position away from the connecting surface to keep in contact the side flaps of the carton in the open position.

The apparatus structured in this way packages groups of products in the cartons using at least the following steps:

grouping together a series of packs of products to form a batch of products which can be housed in a carton;

preparing the batch of products on the lifting surface;

raising the lifting surface to move the batch of products coplanar with the pushing element and the connecting surface;

housing the batch of products in the carton previously prepared downstream of the connecting surface and using the horizontal pushing of the pushing element along the same connecting surface.

As may be inferred from the description, the two apparatuses have different operating structures, in particular in terms of the following parts:

different arrangement of the individual packs in the batches;

different lengths of the channels feeding the batches of products (connecting surface and tunnel forming tubular film);

different structures and distances of the connecting surface from the loading zone (carton) and of the tunnel from the release zone (bag).

Therefore, if both types of packaging are required (bags and cartons), it is necessary to:

prepare two separate apparatuses and respective operating islands in the company;

prepare two different operating modules, interchangeable on the production line, one for formation of the wrapping film and the other structured for filling the carton.

However, in both solutions:

the length occupied inside the company is high and there are high operating costs;

there is an increase in amortisation costs if a production line or module is not used in the absence of requests for packed products.

Moreover, the use of two interchangeable modules has a further disadvantage caused by lengthy plant stoppages resulting from the extremely complex module changing, due to the dimensions of the components.

SUMMARY OF THE INVENTION

The aim of this invention is to provide an apparatus for packaging batches of products packed in cartons or wrapping film which overcomes the above mentioned drawbacks of the prior art.

More specifically, the aim of this invention is to provide an apparatus for packaging batches of products packed in cartons or wrapping film which can modify the type of packaging from cartons to wrapping film and vice versa, substantially maintaining the overall dimensions of a single apparatus and with a single operating island.

Another aim of this invention is to provide an apparatus for packaging batches of products packed in cartons or wrapping film which can maintain the packaging productivity within the traditional unit of time of one or other of the above-mentioned packaging types.

These aims are fully achieved by an apparatus for packaging batches of products packed in cartons or wrapping film according to this invention, as characterised in the appended claims.

These aims are also fully achieved by a method for packaging batches of products packed in cartons or wrapping film according to this invention, as characterised in the appended claims.

More specifically, the apparatus for packaging batches of products packed in a carton or wrapped in a wrapping film, comprises means of grouping individual packs of products in batches of products; a lifting surface to lift the batch from a first height for receiving to a second height for introducing; an element for pushing the batch, positioned at the second height, movable in both directions, along a direction of movement, between a retracted non-operating end position and an extended operating end position for pushing the batch towards a zone loading designed to be engaged by a carton to be filled and a connecting surface for the sliding of the batch interposed between the lifting surface and the loading zone.

According to the disclosure, the apparatus comprises the connecting surface having a pair of vertical side walls and an upper horizontal wall in such a way as to form a tunnel.

Also according to the disclosure, the apparatus comprises a station for feeding wrapping film.

Also according to the disclosure, the apparatus comprises folding means for supporting and guiding the wrapping film wound round the outer walls forming the tunnel; the folding means are supported at least by the two horizontal walls of the tunnel.

Also according to the disclosure, the apparatus comprises first means for longitudinal sealing of the film to join two longitudinal flaps of the film to form a tubular shape.

According to the disclosure, the apparatus comprises second means for transversal sealing of the film positioned close to the rear end of the tunnel for joining the top and bottom flaps of the tubular wrapping film.

Also according to the disclosure, the apparatus comprises a first pair of panels connected to the connecting tunnel for containing/retaining the batch coming out from the tunnel. The first pair of panels has means for their sliding along the side walls, in both directions, in such a way as to modify the operating length of the tunnel (for a stroke equal to the maximum dimension of the flaps of the carton).

According to this structure, the apparatus may be used both for packaging batches of products in cartons and for wrapping batches of products with film in a single work island and with the components of both the operating configurations always mounted, but not interfering with each other when not used.

This allows the operating configuration of the apparatus to be changed in reduced times and with few manual operations.

The presence of the telescopic panels also makes it possible to adapt the operating length of the tunnel to the type of format of the batches to be fed to the carton or to retain the batch being fed during its wrapping in the tubular film.

This invention also provides a method for packaging batches of products in cartons, comprising the steps of:

- preparing a open carton in a loading zone;
- forming a batch comprising a plurality of individual packs on a lifting surface;
- lifting the batch of products from a first height for forming batches to a second height for introducing batches;
- pushing the batch towards the open carton along a connecting tunnel and using an element for pushing the batch along a direction of movement;
- filling the carton with a batch.

According to the disclosure, the step of forming a batch of products comprises forming the batch with a size, in length, calculated along the direction of movement, which is greater than the maximum depth of the carton to be filled.

Also according to the disclosure, the step of pushing the batch of products is divided into at least a first push to fill the carton with a first quantity of products of the batch equivalent to the depth of the carton, a step of retaining and containing the remaining products of the batch along the tunnel and between the tunnel and the loading zone, also by means of the side panels and a further second pushing on the remaining products of the batch, after the preparation of another carton to be filled into loading zone, to fill the carton set up there.

BRIEF DESCRIPTION OF THE DRAWINGS

These and other features of the invention will become more apparent from the following description of a preferred, non-limiting embodiment of it, with reference to the accompanying drawings, in which.

DESCRIPTION OF THE PREFERRED EMBODIMENTS

Figure 1:
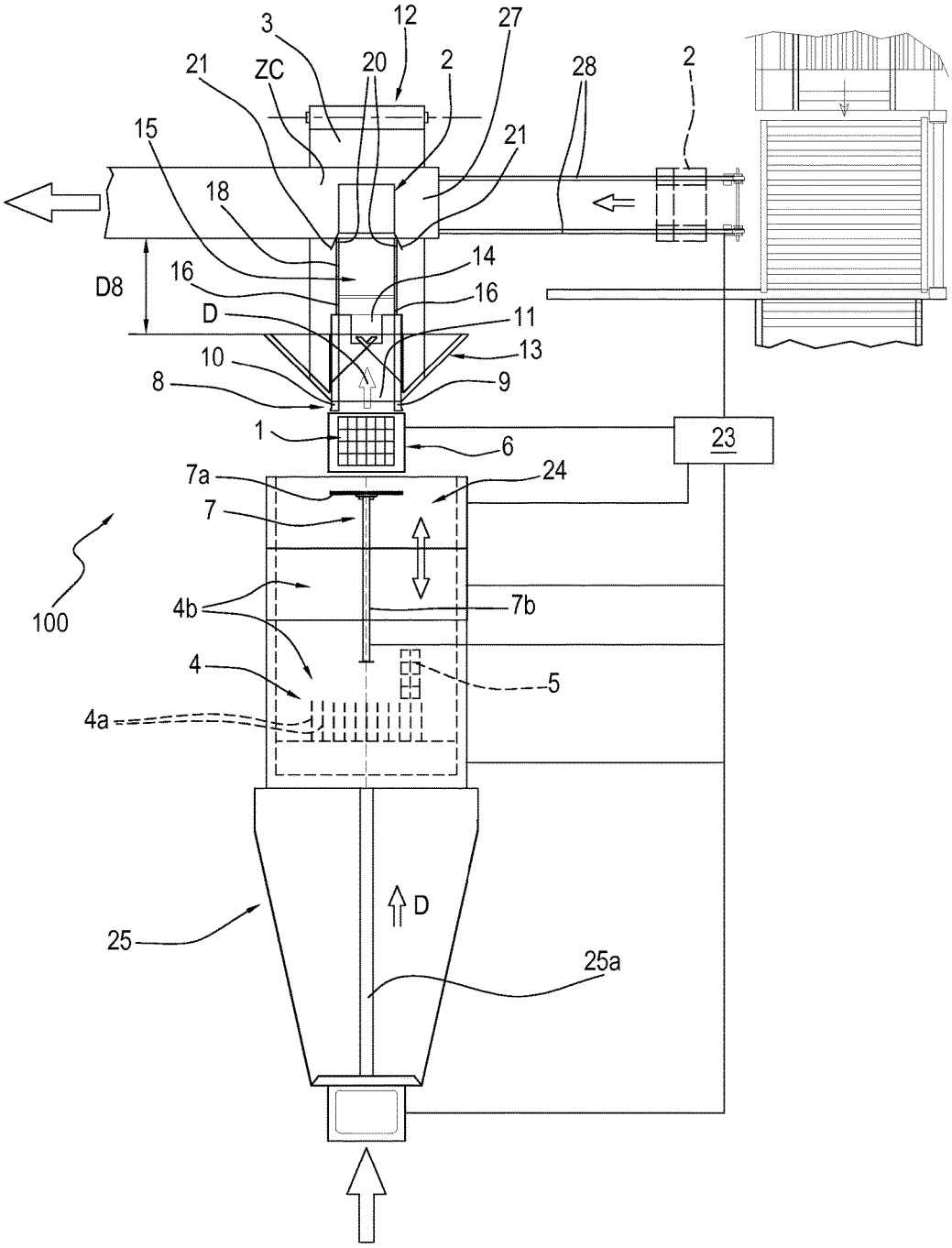
FIG. 1 shows a schematic top plan view with some parts cut away to better illustrate others of the apparatus for packaging batches of products packed in cartons or wrapping film, according to this invention, in a configuration for packaging cartons.

With reference to the accompanying drawings and with particular reference to FIG. 1, the apparatus according to this invention, denoted in its entirety by the numeral 100 is used for packaging batches 1 of products.

More specifically, but without limiting the scope of protection of this invention, the products to be packaged are of the "tissue" type, that is, rolls, such as rolls of toilet paper or kitchen paper and wherein each roll comprises a tubular central core on which a quantity of paper product is wound.

More specifically, the term batches 1 (or even collections) of products means a predetermined number of individual packs 5 closed and grouped together, according to predetermined volumes, in a batch 1.

Each closed pack 5 comprises a predetermined number of rolls which can vary according to the need (for example, packs of four, six or eight rolls, in single or double layers etc.), so the number of individual packs 5 in a batch 1 to be packaged can vary both depending on the type of packaging and the volumetric size decided for the batch 1.

In other words, a batch 1 of products is the sum of a predetermined number of individual closed packs 5 of rolls.

It should be noted that the apparatus 100 according to this invention is used for packaging batches 1 of products packed in a carton 2 or wrapped in a wrapping film 3.

More specifically, the apparatus 100 comprises a station for feeding the individual closed packs 5 along a direction D of movement (see FIG. 1).

The feed station 25 comprises at least one channel 25*a* for feeding individual packs 5 in succession towards means 4 (for example, power-driven grouping bars) for grouping the individual packs 5 into batches 1 of products (there may be several feed channels according to the productions speeds and the dimensions of the batches).

These grouping means 4 comprise a plurality of channels 4*a* (divider lines) which are parallel and adjustable. The channels 4*a* are supplied in succession from the channel 25*a* for positioning the individual packs on a surface 4*b* for forming batches 1.

It should be noted that the individual packs 5 of products are fed and positioned on the surface 4*b* (in the case of rolls) in a configuration wherein the longitudinal axis of the corresponding core tubular is parallel to the direction of movement (this first configuration is maintained for a packaging in carton 2).

The surface 4*b* is equipped with means for feeding and compacting the individual packs 5 in a batch 1 of products (for example, by using motor-driven drives used like the transversal bars—not illustrated).

The batch 1 is formed and positioned on a lifting surface 6.

The lifting surface 6 is configured to lift the batch 1 by a first height Q1 for receiving the batches 1 to a second height Q2 for introducing the batch 1.

The lifting surface 6, in its minimum configuration, can move from a lowered position coplanar with the surface 4*b* to a raised position coplanar with the pushing element 7.

In light of this, the lifting surface 6 can also move from the second height Q2 (raised position) coplanar with the surface 4*b* to a series of several first positions Q1 which are lower at different heights so that they can make layers of products 5 for layered batches 1.

The element 7 for pushing the batch 1, positioned at the second height Q2, configured to move, in both directions, along the direction D of movement at least between a retracted non-operating end position and an advanced operating end position for pushing the batch 1 towards a loading zone ZC designed to be engaged by a carton 2 to be filled.

In light of this, the pushing unit 7 comprises a pushing head 7*a* connected to a linear actuator 7*b* for movement in both directions.

The apparatus 100 also comprises a connecting surface for the sliding of the batch 1 interposed, at the corresponding front and rear ends, between the lifting surface 6, when positioned at the second operating height Q2, and the loading zone ZC.

It should be noted that the zone loading ZC comprises a surface 27 in which, when necessary, the open carton 2 is positioned awaiting the products.

In light of this (merely by way of an example) the surface 27 comprises a pair of belts of which one fixed (on the products infeed side) and the other adjustable according to the depth of the carton 2 to be filled.

The surface 27 is fed with cartons by a series of components for preparing and positioning the carton 2 in the zone ZC of the surface 27.

In light of this, the carton 2 is placed on a system of motor-driven belts 28 when it is still laid out flat (not open and folded back on itself).

The carton 2 is moved along the belts 28 until reaching an opening carriage (not illustrated) which allows a first partial lifting of the long walls of the carton 2 with simultaneous activation of suction cups (not illustrated) positioned in the upper part of the carriage for striking and retaining the short side of the carton 2.

As soon as the suction cups have started to grip, the carriage may completely open the carton which is, therefore, put into shape.

The carriage translates towards the loading zone ZC to move the carton 2 into the loading position. During this movement, the upper and lower flaps are kept open in the rear part (bottom) of the carton 2 whilst the side flaps are closed to provide an opposing force to the insertion of the batch 1 of products.

The front side flaps 21 and the top and bottom of the front side (side for inserting batches of products) are kept open.

Figure 2:
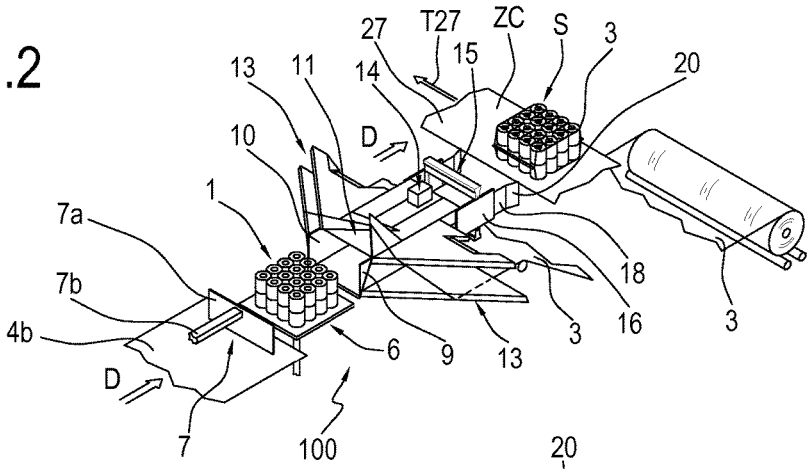
FIG. 2 shows a perspective view with some parts cut away in order to better illustrate others of a part of the apparatus of FIG. 1 in an operating configuration of a packaging cycle of a batch of products with a wrapping film.

According to FIG. 2, the apparatus 100 comprises the connecting surface having a pair of vertical side walls 9, 10 and an upper horizontal wall 11 in such a way as to form a tunnel 8 (hereafter referred to as the connecting surface).

The apparatus 100 comprises a station 12 for feeding wrapping film 3.

The apparatus 100 comprises folding means 13 (also called ties) for supporting and guiding the wrapping film 3 round the walls of the tunnel 8. The folding means 13 are supported by at least a lower part of the tunnel 8 and by its upper wall 11 to wrap the film 3 around the outer walls of the tunnel 8.

The apparatus 100 comprises first means 14 for longitudinal sealing of the film 3, positioned on the upper wall 11 of the tunnel 8 and configured to join two longitudinal flaps of the film 3 to form a tubular shape (continuous after sealing).

The apparatus 100 comprises second means 15 for transversal sealing of the film 3 positioned close to the rear end of the tunnel 8 for joining the top and bottom flaps of the tubular wrapping film 3.

The apparatus 100 comprises at least a first pair of panels 16 connected to the corresponding side walls 9 and 10 of the tunnel 8 for containing/retaining the batch 1 of products coming out of the tunnel 8. The first pair of panels 16 has means 17 for their sliding along the side walls 9, 10, in both directions, in such a way as to modify the operating length of the tunnel 8.

Alternatively, the first pair of panels 16 may be connected to the corresponding side walls of the folding means 13.

Preferably, the first pair of panels 16 comprises a lower connecting surface between the two vertical walls positioned and slidable below the horizontal surface of the tunnel 8.

In light of this, the first pair of panels 16 comprises a lower horizontal sliding base (to define a "U" shape) under the horizontal surface of the tunnel 8. In this way, the three walls of the pair of first panels 16 form a movable projection of the tunnel 8.

It should be noted that between the rear position of the tunnel 8 and the loading zone ZC there is a predetermined distance D8 which is operatively modified by the movement of the first pair of panels 16.

In light of this, the first pair of panels 16 can move between a first non-operating end position, wherein the two panels 16 (and the bottom) are positioned inside the dimensions of the corresponding wall 9 and 10 of the tunnel 8, and a second end position, wherein the two panels 16 (and the bottom) protrude from the corresponding side wall 9, 10 of the tunnel 8.

According to this structure of the apparatus 100, the packaging line can be used both for packaging batches 1 of products in cartons and for wrapping batches with film: all of this without replacing any type of component, but by changing the operating sequence for feeding and moving several elements present and always present in the apparatus.

To this must be added the fact that the overall dimensions of the apparatus are not modified by the presence of the film feeding station, folding means and sealing means which, in effect, use spaces already present in the apparatus.

Preferably, the apparatus 100 comprises a second pair of panels 18 with an articulated connection to the first pair of panels 16 and projecting towards the loading zone ZC.

On the second pair of panels 18 first actuators 19 act which are able to set the incline for each second panel 18 relative to the corresponding first panel 16 at least towards the inner space defined by the same pairs of panels 16, 18, in such a way as to also modify the width of the inner space for retaining/maintaining batches 1 of products between the tunnel 8 and the loading zone ZC.

Preferably, the first actuators 19 are connected, laterally, between the first pair of panels 16 and the second pair of panels 18.

Advantageously, the second pair of panels 18 determines both a further modification (elongation) of the operating length of the tunnel 8 and the possibility of guiding/retaining the batches of products passing between the tunnel 8 and directed towards the loading zone ZC along a channel generated by the panels 16, 18.

More specifically, the means 17 (linear actuators) for moving the first pair of panels 16 are connected to the pair of walls 9 and 10 of the tunnel 8 and are able to move the panels 16 parallel to the side walls 9 and 10.

Alternatively, if the pair of first panels 16 is connected to the folding means 13, the movement means 17 (linear actuators) can be associated with the walls defining the folding means 17.

A further alternative (not illustrated) of the movement means 17 comprises a brushless motor positioned on the outer bottom of the tunnel 8 and connected by a kinematic mechanism to the bottom of the first pair of panels 16 for guiding the above-mentioned movement of the panels 16.

The second pair of panels 18 moves parallel to the direction D of movement, in both directions, with the movement of the first pair of panels 16 to which it is articulated.

On the other hand, the first actuators 19 acting on the second pair of panels 18 determine the rotation of the second panels 18 according to the operational requirements for retaining the products (inclination towards the inside of the products transit channel) or for free transit of the batches of products towards the loading zone ZC (position substantially coplanar of the second panels 18 to the first panels 16).

Preferably, the apparatus 100 comprises a third pair of panels 20 operatively connected, in a first solution, to the first pair of panels 16 and configured to hold, in use, the side flaps 21 of the carton 2 in an open configuration and in such a way as to form a channel with a constant width between the tunnel 8 and the loading zone ZC.

Figure 6:
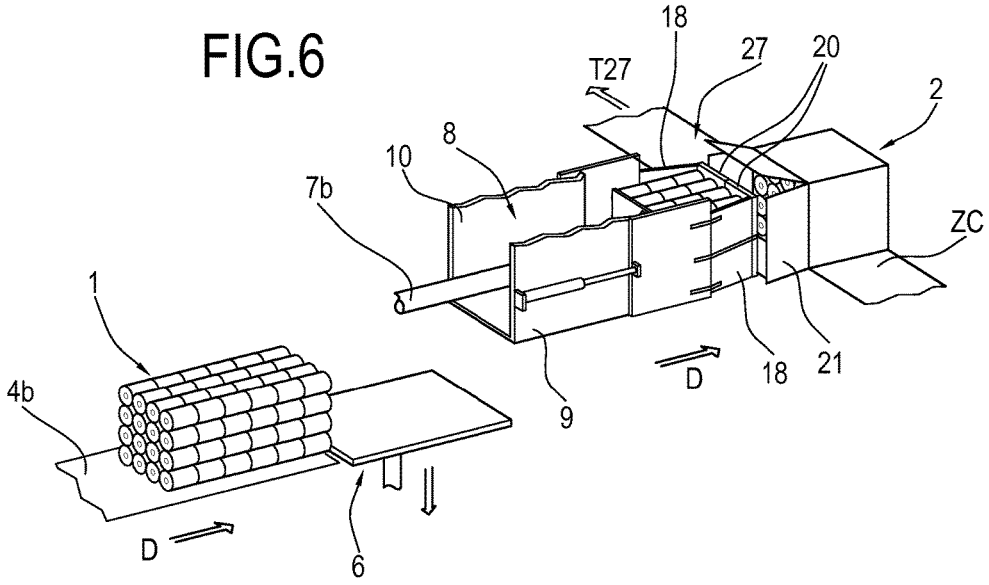

In light of this, the third pair of panels 20 comprises second actuators 22 which are able to rotate the panels 20 at least between a first end operating position, coplanar with the second pair of walls 18, for the passage of a batch 1 of products, and a rotated second end operating position, to close the channel formed by the panels 16, 18, 20, wherein the third panels 20 are positioned inclined (or even perpendicular) with respect to the second pair of panels 18 (see FIG. 6).

In an alternative embodiment, not illustrated, the third pair of panels 20 may be connected, indirectly, to the tunnel 8, either laterally or below it.

In light of this, the second actuators 22 act as a direct support to the third pair of panels 20 and are connected by a kinematic mechanism to the movement of the first pair of panels 16.

The feeding of the panels 16 determines the feeding and opening of the third pair of panels 20 approaching the loading zone ZC in the first operating position; the retraction of the panels 16 determines a consequent rotation of the third panels 20 in the second operating position (for releasing the filled carton), and assisting the second panels 18.

The third pair of panels 20 therefore has a dual operational purpose:

- in the open position it performs the function of forming an opposing force to keep the side flaps 21 of the carton 2 in an open configuration so as to allow the passage of the batch 1 of products towards the inside of the carton 2 (FIGS. 3-5);
- in the closed configuration it blocks and retains the remaining products of a batch 1 of products inside the channel formed by the panels 16 and 18 (FIG. 6).

As mentioned, the closing of the third pair of panels 20 makes it possible to release the flaps 21 from the contrast and eject the filled carton 2 according to a trajectory T27 transversal to the direction D of movement.

Preferably, the apparatus 100 comprises a control unit 23 for selective control of the apparatus 100 between an operating configuration for filling cartons 2 and an operating configuration for forming tubular wrapping film 3, and vice versa.

Preferably, the apparatus 100 comprises a station 24 for orientation of the individual packs 5 fed by the station 25 for feeding individual closed packs 5 along the direction D of movement.

In light of this, the orientation station 24 is positioned upstream of the means 4 for grouping together the individual packs 5 in batches 1 of products with predefined dimensions, relative to the direction D of movement.

The orientation station 24 is configured to rotate the individual packs 5 of products in arrival from a first configuration for their packaging in cartons 2 (with longitudinal axis of the tubular core of the products positioned parallel to the direction D of movement) to a second configuration for their packaging in wrapping film 3 (with longitudinal axis of the tubular core perpendicular to the direction D movement).

It should be noted that this orientation station 24 comprises a tipping system (not illustrated) which is able to rotate by a right angle each individual pack 5 fed by the feeding station 25.

This orientation station 24 is activated by the control unit 23 in the presence of an operating configuration of the apparatus 100 for packaging the batches 1 in wrapping film 3.

With the apparatus 100 in the configuration for packaging the batches 1 in cartons 2, the orientation station 24 remains a simple surface for the transit of the individual packs 5.

Preferably, the above mentioned station 12 for feeding film 3 comprises a roll of film 3 located in the proximity of the loading zone ZC.

Preferably, the roll can be positioned to the rear of the surface 27 of the loading zone ZC (relative to the direction D of movement); more specifically, the reel can be positioned at a height lower than the surface 27 and the tunnel 8, in such a way as to allow the unwinding of the film 3 from the reel to the folding means 13 along a surface below the surface 27 and not interfering with the surface 27 (see FIG. 2).

The folding means 13 (or ties) are connected both to the corresponding upper and lower horizontal walls of the tunnel 8 and to the side walls 9 and 10 of the tunnel 8.

In light of this, the folding means 13 are configured for folding the film 3 around the outer part of the walls of the tunnel 8.

It should be noted that the folding means 13 (or ties) comprise an outer structure or frame with folding triangles and an outer one which is formed by the tunnel 8 containing the batches 1 of products being pushed. The tubular film 3 runs between the tie inner tie (tunnel 8) and the outer one defined by the folding means.

In effect, between the folding means 13 and the tunnel 8 there is a hollow space for shaping the wrapping film 3 into a tubular shape: basically, the tunnel 8 is used as tubular surface for separating film 3—batch 1 of products during the step for feeding batch 1 and unwinding film 3.

On the upper wall 11 of the tunnel 8 there are the first sealing means 14 for sealing the free longitudinal flaps of the film 3 and configuring the film 3 into a closed tubular shape.

Preferably, the second sealing means 15 have actuator means 26 for moving them, in both directions, along a trajectory T15 perpendicular to the direction D of movement.

The actuator means 26 are connected to a frame 31 for supporting the second sealing means 15.

Again preferably, the second sealing means 15 are connected to the first pair of panels 16 in such a way as to move with the first panels 16 along a direction T16 parallel to the direction D of movement during contact with the top and bottom flaps of the film 3 to be sealed.

More specifically, the second sealing means 15 are connected to the first pair of panels 16 using the frame 31.

In light of this, the second sealing means 15 comprise two sealing bars 29 and 30 facing each other and equipped with a top profile complementary to each other for sealing the transversal top and bottom flaps of the film 3 to form the bag and, simultaneously, separate the bottom flap of the bag just formed from the top flap of next bag still to be formed.

In short, the interaction of movements between the first pair of panels 16 and the sealing bars 29 and 30 makes it possible to obtain the correct closing of the bag with the batches 1 of products.

As mentioned above, the loading zone ZC is positioned at a predetermined distance D8 from the rear end of the tunnel 8 in such a way that it can be adapted to both the operating configurations.

In other words, the distance D8 between tunnel 8 and ZC (that is to say, the surface 27) is designed to operate for feeding, positioning and releasing cartons and to accept and release the bag S formed during the configuration for operating the apparatus as a bagging unit.

In both the operating configurations of the apparatus 100, the supporting surface 27 discharges the filled carton 2 or the batch 1 of products wrapped in the tubular wrapping film 3 along a trajectory T27 perpendicular to the direction D of movement.

Preferably, the lifting surface 6 comprises two half-surfaces 6*a*, 6*b* supporting the batches 1 of products.

In light of this, the half-surfaces 6*a*, 6*b* are also movable independently of each other by actuators which are separate and controlled by the control unit 23.

The separation of the lifting surface 6 makes it possible to adapt the feeding even with batches 1 of products which are very long and which can be used (in particular, but not necessarily) for packaging with wrapping film 3.

This invention also provides a method for packaging batches 1 of products in cartons 2, comprising the steps of:

- preparing an open carton 2 in a loading zone ZC;
- forming a batch 1 comprising a plurality of individual packs 5 on a lifting surface 6;
- lifting the batch 1 of products from a first height Q1 for forming batches 1 to a second height Q2 for introducing batches 1;
- pushing the batch 1 towards the open carton 2 along a connecting surface or tunnel 8 (operatively defined as hopper in this apparatus configuration) and using an element 7 for pushing the batch 1 along a direction D of movement;
- filling the carton 2 with a batch 1 of products.

According to the invention, the step of forming a batch 1 of products comprises forming the batch with a size L, in length, calculated along the direction D of movement, which is greater than the maximum depth P of the carton 1 to be filled.

Also according to the invention, the step of pushing the batch 1 of products is divided into at least:

- a first push to fill the carton 2 with a first quantity of products of the batch 1 equivalent to the depth of the carton 2;
- a step of retaining and containing the remaining products of the batch 1 along the tunnel 8 and between the tunnel 8 and the loading zone ZC, also by means of the side panels 16, 18, 20;
- a further second pushing on the remaining products of the batch 1, after preparing another carton 2 to be filled in the loading zone ZC, for filling the further carton 2 set up there.

In a first solution, in the step of forming a batch 1 of products the length L of the batch 1 of products formed is a multiple of the depth of the carton 2, and wherein the steps of pushing the batch 1 of products already housed in the tunnel 8 are equal to the number of cartons 2 to be filled.

In a second alternative solution, in the step of forming a batch 1 of products the length L1 of the batch 1 of products formed is different by a multiple of the depth of the carton 2, and wherein the steps of pushing the batch 1 of products already housed in the tunnel 8 are spaced by at least another step for pushing a further batch 1 of products at the rear of the remaining quantity of products of the previous batch 1 retained in the tunnel 8.

In light of this, a step is repeated, when necessary, for lifting a further batch 1 of products (with controlled pushing element 7 in retracted position) and a step for further pushing along the tunnel 8 of the further batch 1 of products.

Preferably, during the step of retaining the remaining individual packs 5 of product of a batch 1 in the tunnel 8, the pusher means 7 is stationary in the tunnel 8 and in contact with the rear of the batch 1 of products contained therein. A few examples can be given to describe further the use of the tunnel 8 as a feed buffer.

The lifting surface 6 preferably has a dimension calculated along the fixed direction D of movement (adding together its two half-parts).

This size is always greater than the maximum depth P of the carton 2 to be filled. The control unit 23 is programmed according to the operating modules for calculating the division between lift length Le (substantially defining batch length L or L1) and length of individual pack 5 forming the batch 1, wherein the length of the batch 1 is formed by the sum of the lengths of the individual packs 5 forming the batch 1 (this dimensions is predetermined during the cycle start).

The whole number deriving from the calculation constitutes the quantity of products which may be housed inside the carton 2 (that is, the quantity of multiple pushes of the pushing element 7).

As mentioned, however, there is the possibility of not having an exact number of pushes equal to a multiple of the products which can be housed in the carton 2; this may be present every time the quantity of products (that is, the number of individual packs 5) which can be housed inside the carton 2 is greater than or equal to twice the length of the individual pack 5.

In order to clarify this programming, by way of an example, it is assumed that the lift length Le is 850 and the length of the individual pack 5 is 400 and it can be housed completely in an individual carton 2.

The batch 1 therefore has a total length L of 800 on the lifting surface 6 and the operating module of the control unit 23 controls the pushing element 7 in a sequence of two multiple pushes (L/2): the first push starting from lifting surface 6, whilst the second, shorter, starts from the stopping point inside the tunnel 8. Each push of the pushing element 7 complete a carton 2.

Further, it is assumed that, with lift length Le of 850, the length of the individual pack 5 of products is 280 and the depth P of the carton 2 allows the housing of the two individual packs 5 (equal to 560).

With this operating configuration, the control unit 23 programs a batch 1 with length L1 equal to the height of three individual packs 5.

At this point, the operating cycle programmed by the control unit 23 comprises:

- a single push of the pushing element 7 to house the two individual packs 5 in the carton 2, leaving a pack 5 waiting inside the panels 16, 18, 20;
- a withdrawal of the pushing element 7 and a subsequent raising of the surface 6 with a further batch 1 formed by three individual packs 5;

two multiple pushes of the pushing element 7 (the first push starting from the lifting surface 6, whilst the second, shorter, push starts from the stopping point inside the tunnel 8). Each of these pushes of the pushing element 7 completes a carton 2 with two individual packs 5.

For this cycle, therefore, three cartons 2 are made every two lifting steps of corresponding batches 1.

Summing up the description so far in terms of apparatus and method (for the configuration of the apparatus and the packaging of the cartons), the batches of products of individual packs are positioned on the lifting surface at the receiving height Q1 (FIG. 6).

Figure 3:
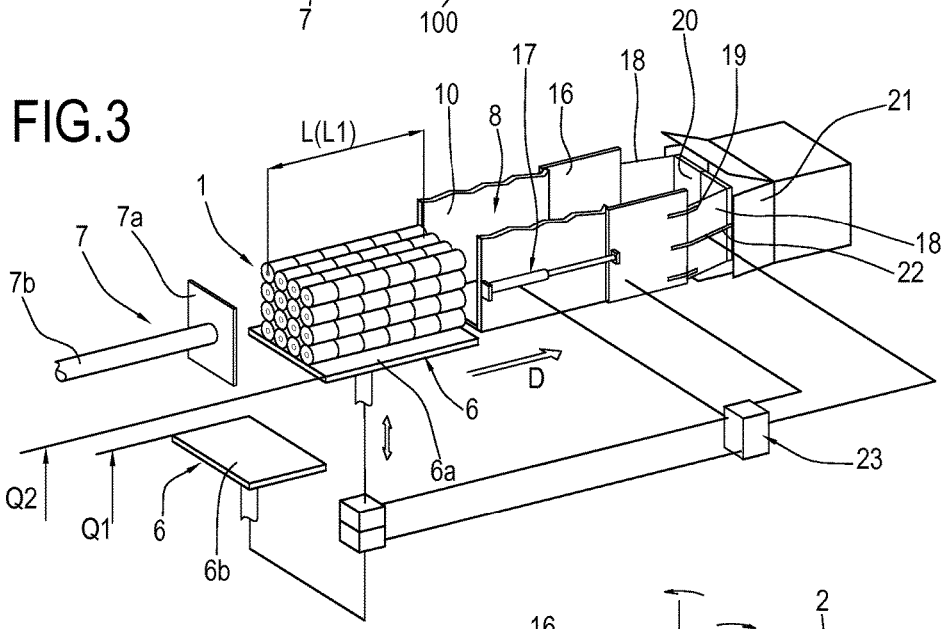
FIGS. 3 to 6 show perspective views of a sequence of steps of the apparatus of FIG. 1 in an operating configuration of a packaging cycle in cartons, wherein the parts of the apparatus relating to the operating configuration of packaging the products with wrapping film have been cut away to better illustrate the parts of interest.

The batch is raised up to the introduction height Q2 and the pushing element is in the non-operating retracted position (FIG. 3).

Figure 4:
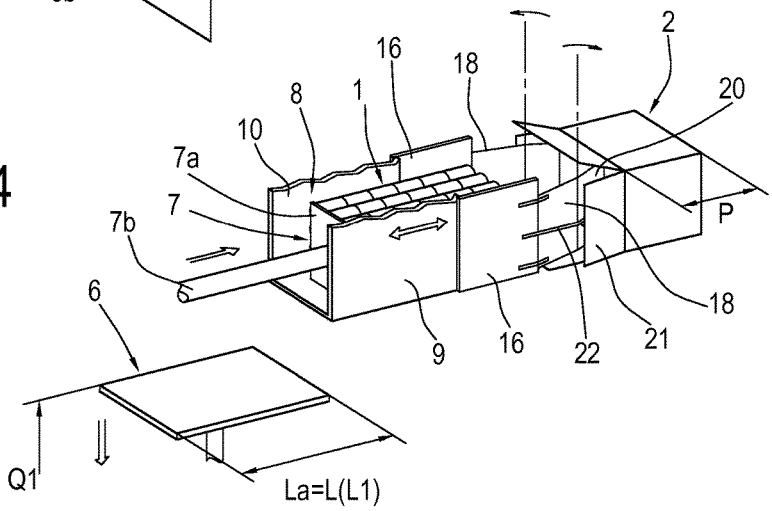

The first and second panels are in a position coplanar with the side walls of the tunnel, whilst the third panels are in a position for closing the passage (FIG. 3). The carton is set up in the loading zone ZC open on the front part and the third panels move to open the flaps (FIG. 4).

At this point, the pushing element introduces the batch of products inside the tunnel and, subsequently, continues to push the batch along the first, second and third mobile panels (all open and substantially parallel to the direction of movement or flow of introduction).

As soon as the batch of products has left the lifting surface, the latter moves down to await the arrival of the next batch of products.

Figure 5:
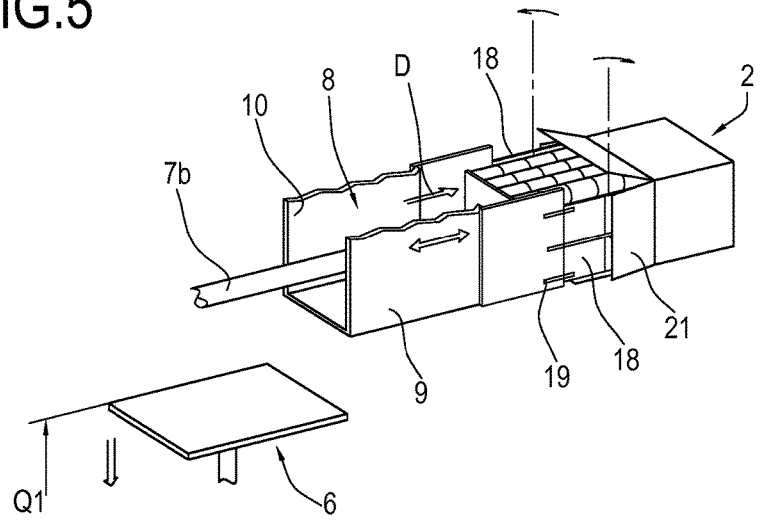

The pushing of the pushing element allows the quantity of batch of products (located at the top) to reach the bottom of the carton (FIG. 5).

It should be noted that the pushing action occurs on the rear of the batch of products, but due to the rigidity of the cores the effect is passed on to the remaining front products of the batch without problems.

During this step, the first pair of panels is, preferably, in the above-mentioned second end position, wherein the two panels protrude from the corresponding side wall of the tunnel, that is, projecting towards the carton.

After filling the carton:

the second pair of panels tilts towards the products left outside;

the first pair of panels retracts towards the tunnel (simultaneously with a retraction movement/adjustment of the pushing element which remains in contact with the bottom of the batch of products) for a length equal to the size of the flap of the carton; this allows the carton to translate to a subsequent folding and gluing station (not illustrated);

the third pair of panels is rotated to close the channel for containing the products and to guarantee a fast release of the full carton from the filling area and for feeding a next one (FIG. 6).

The closing of the third pair of panels also guarantees a twofold safety for containing the remaining products if there are rolls and/or products which are too soft and with a large number of rows (a typical example is single toilet rolls).

It should be noted that during the step for compressing the second pair of panels the products contained are squashed and, as they are not able to move downwards, due also to the presence of the surface forming the tunnel, they may only move upwards where there are no constraints.

As soon as the new carton has arrived, the first pair of panels starts to translate, whilst the third pair of panels is fed towards the carton and it opens to lock in an open position the flaps, guaranteeing, simultaneously and as a function of the opening of the latter, the retaining of the product also by the second panels.

At this point, the pushing element can start pushing the product again, simultaneously also, for a stretch, with the first pair of panels.

After completion of the stroke of the first panels the stroke of the element for pushing the products continues in such a way as to insert the product through the remaining panels and down to the bottom of the carton.

During this latter step, the pushing element has reached its operating end of stroke position with the products pushing with the cardboard cores (in the case of rolls) against the closed flaps on the bottom of the carton.

The second and third pair of panels are positioned parallel to the direction D of movement and the first pair of panels is in the advanced operating position.

The apparatus, as mentioned above, makes it possible to operate, without structural modifications, as a device for bagging batches wrapped in film.

The preparation of the apparatus is simple.

The film is unwrapped from the reel and wound around the folding means and then about the walls of the tunnel until the free longitudinal flaps are moved onto the first sealing means, and a pair of transversal flaps close to the rear end of the tunnel and they are closed there by the second transversal sealing means to have a cycle start point.

As already mentioned, in the packaging cycle with bagging or wrapping mode, the batches of products enter with the core of the products facing upwards (that is, perpendicular to the direction D of movement).

In this case, the control unit activates the orientation station 24 for modifying the position of the individual packs 5 before they are placed in batch 1 on the lifting surface.

The lifting surface therefore only acts as a "depot" for carrying the batch from the receiving height Q1 to the introducing height Q2.

After the lifting, the batch 1 is pushed by the pushing element inside the tunnel/inner tie which has the function of forming the "tubular" length of film about the perimeter of the batch of products.

The film, as mentioned above, is unwound around the outer structure with the folding triangles and the tunnel walls which contains the batch being pushed.

Figure 7:
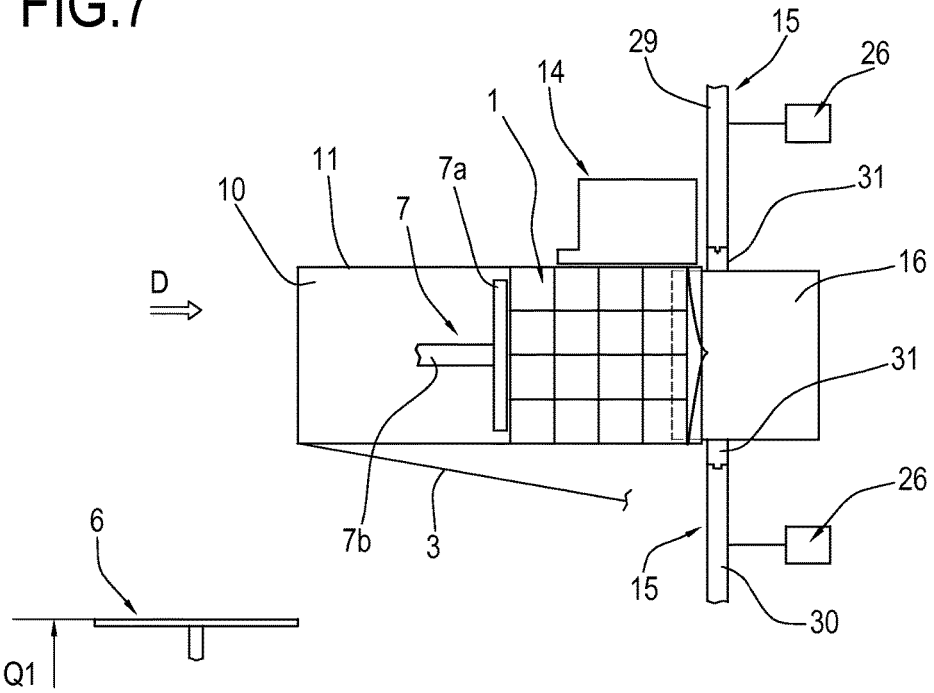
FIGS. 7 to 10 show schematic side views with some parts cut away to better illustrate others of a sequence of steps of the apparatus shown in the figures in an operating configuration of a packaging cycle with wrapping film.
Figure 8:
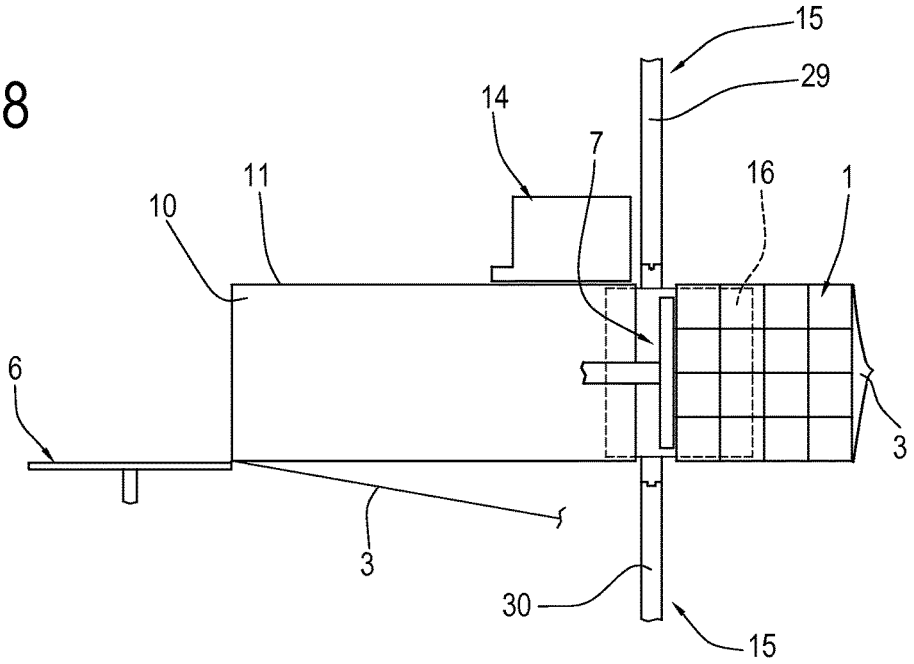
Figure 9:
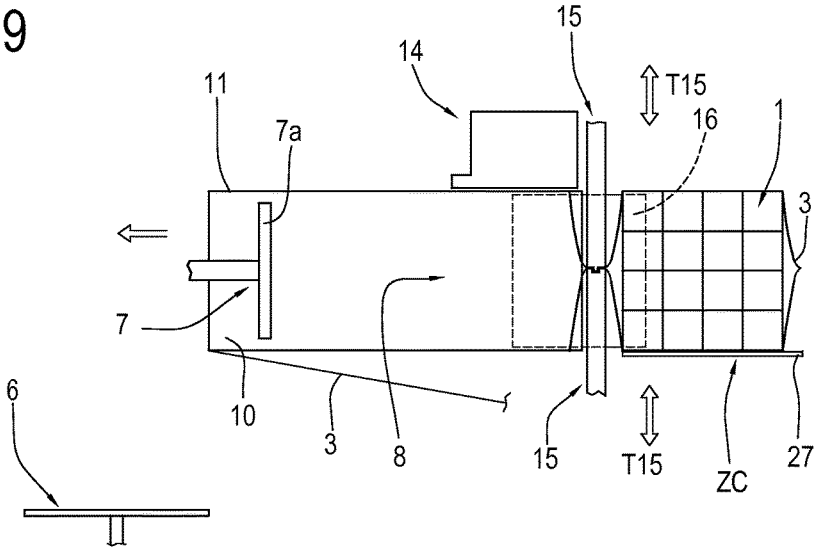

At this point, the steps for making the wrapped package comprise, starting from the means for pushing into the retracted position, raised lifting surface, second sealing means which have closed the transversal top flaps of the film (FIG. 7) and there is therefore a tubular film with front end closed:

pushing the batch along the tunnel until contact with the closed front of the film (and transversal sealing upon arrival of the product—FIG. 7);

further pushing on the batch of products with extraction of the tubular length of film with the batch of products beyond the rear end of the tunnel; the stroke of the pushing element must exceed the transversal sealing line (a function of the size of the bag set up), FIG. 8;

retracting the pushing element towards the retracted end point;

closing the transversal rear flaps of the bag;

separating the rear flaps of the bag formed by successive front flaps of the bag to be formed (FIG. 9).

It should be noted that during the sealing step the second sealing means only move along the vertical trajectory T15.

Figure 10:
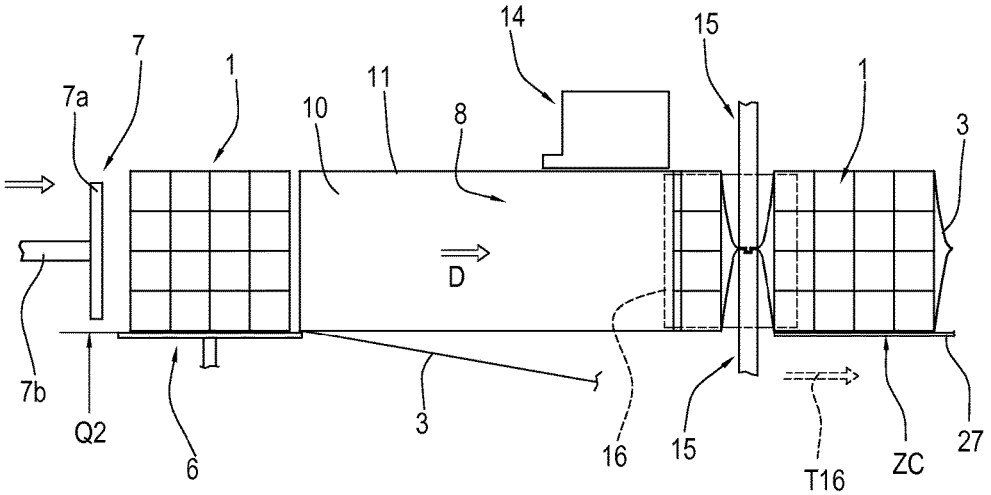

The time necessary for the correct sealing, maintaining a trajectory of movement (T16) parallel to the direction of movement (D) to ensure a contact on the flaps such as to guarantee correct closing and cutting is achieved by translation of the first pair of panels to which the second sealing means can be connected, in such a way as to determine stroke tracking. (see FIG. 10).

As the bag is coming out from the tunnel, the second and third pair of panels are kept parallel to the direction D of movement to align the bag in the correct direction towards the loading zone ZC.

Here the bag is released transversely to the direction D of movement towards the storage and/or palletizing systems.

As confirmation of the validity of the solution described above, a further variant of the wrapping process is possible using the group of end panels of the tunnel 8.

A first example (not illustrated) comprises:

raising/loading (for example) a series of products to be used to form two different batches to be wrapped in the tunnel;

feeding of the batch up to an intermediate height (batch completely out of the tunnel further downstream relative to the direction D of movement—that comes into contact with the top of the closed film—and partial coming out of the second subsequent batch) thanks also to the first pair of panels feeding along the direction D;

retaining the first batch downstream by activating the second pair of panels and also the third panels for closing the channel formed by the panels;

retraction of the subsequent batch further upstream, by moving of the first panels in the opposite direction to the direction D of movement and with the pusher that retracts in a coordinated fashion with the first panels whilst in contact with the bottom of the batch of products until the re-entry of the batch upstream inside the tunnel;

closing the first batch by lowering the second sealing means;

releasing the first batch in the loading zone with simultaneous feeding (by activating the pushing element) and opening the second batch to complete the cycle of wrapping the two batches fed.

A second example or embodiment of this method (not illustrated) may comprise:

raising/loading (for example) a series of products to be used to form two different batches to be wrapped in the tunnel;

feeding of the batch up to an intermediate height (batch out of the tunnel further downstream relative to the direction D of movement—that comes into contact with the top of the closed film—whilst the subsequent batch remains inside the tunnel close to the end of the tunnel);

retaining the first batch downstream by activating the second pair of panels and also the third panels for closing the channel formed by the panels;

separating the two batches by moving the first panels (with pusher stationary) along the direction D of movement;

closing the first batch by lowering the second sealing means;

releasing the first batch in the loading zone with simultaneous feeding (by activating the pushing element) and opening the second batch to complete the cycle of wrapping the two batches fed.

Thanks to this type of apparatus, the invention fully achieves the pre-set aims.

The apparatus structured in this way can be used both for placing products in cartons and for wrapping products without modifying or replacing any type of component.

This allows the operating configurations to be changed very quickly.

The majority of the components are optimised for being functional for both the operating configurations (for example, tunnel, panels, pushing element, loading/discharging surface).

The need to extend the stroke of the pushing element (necessary to perform the cyclic operations of the wrapping with film) is resolved by using the tunnel as a buffer in the packaging with cartons and using the containment panels.

In other words, it eases the feeding of the load, reduces the stroke of the pusher into pushing sub-steps and uses the panels as an auxiliary telescopic "buffer".

What is claimed is:

1. An apparatus for packaging batches of products in a carton or in a wrapping film, comprising:

a tunnel into which a batch of products to be wrapped can be slid from an entry end to an exit end in a longitudinal movement direction toward a loading zone, the tunnel having a pair of vertical side walls;

a pusher for pushing the batch of products into and through the tunnel in the longitudinal movement direction;

at least a first pair of panels connected to the tunnel for containing/retaining the batch of products coming out from the tunnel; the first pair of panels forming longitudinal extensions of the side walls and being longitudinally moveable in opposite directions in such a way as to modify the operating length of the tunnel;

a station for feeding wrapping film;

a film folder configured to support and guide the wrapping film around the exterior of the tunnel;

a longitudinal sealer positioned on an upper wall of the tunnel and configured to join two longitudinal flaps of the wrapping film to form a tubular shape;

a transversal sealer positioned at the exit end of the tunnel for contacting and joining top and bottom flaps of the tubular shape; and an actuator for moving the transversal sealer perpendicular to the longitudinal movement direction between a non-sealing position and a sealing position for joining the top and bottom flaps; and wherein the transversal sealer is connected to the first pair of panels for longitudinal movement with the first pair of panels when in contact with the top or bottom flaps of the wrapping film to be sealed.

2. The apparatus according to claim 1, comprising a second pair of panels with an articulated connection to the first pair of panels and projecting towards the loading zone; and first actuators which are able to set an incline for each panel of the second pair of panels relative to a corresponding first panel at least towards an inner space defined by the first pair of panels, in such a way as to also modify a width of the inner space for keeping/retaining the batch of products during movement from the tunnel to the loading zone.

3. The apparatus according to claim 2, comprising a third pair of panels operatively connected to the second pair of panels and configured to retain, in use, side flaps of a carton in an open configuration and in such a way as to form a channel of constant width between the tunnel and the loading zone.

4. The apparatus according to claim 3, including second actuators for rotating the third pair of panels at least between a first end operating position, coplanar with the second pair of walls, for the passage of a batch of products, and a rotated second end operating position, to close the channel, wherein the third panels are positioned inclined with respect to the second pair of panels.

5. The apparatus according to claim 1, wherein the tunnel has an upper horizontal wall.

6. The apparatus according to claim 1, comprising a controller for selective control of the apparatus between an operating configuration for filling cartons and an operating configuration for forming tubular wrapping film.

7. The apparatus according to claim 1, comprising an orientation station for orienting individual packs of products fed by a station for feeding along the longitudinal movement direction; the orientation station being positioned upstream of a means for grouping the individual packs in batches of products with predetermined dimensions relative to the longitudinal movement direction; the orientation station being configured to rotate the individual packs of products arriving from a first configuration for packaging in cartons to a second configuration for packaging in wrapping film.

8. The apparatus according to claim 1, wherein the loading zone, positioned at a predetermined distance from the exit end of the tunnel comprises a surface for supporting and releasing a filled carton or the batch of products wrapped in the wrapping film along a trajectory perpendicular to the longitudinal movement direction.

9. The apparatus according to claim 1, wherein the first pair of panels has a lower connecting surface between the pair of vertical side walls positioned and slidable below a horizontal surface forming part of the tunnel.

10. The apparatus according to claim 1, comprising means for grouping individual packages of products into the batch of products; and a vertically movable lifting surface for moving the batch of products from a first height to a second height vertically aligned with the tunnel such that the batch of products can be pushed from the lifting surface into the tunnel.

11. The apparatus according to claim 10, wherein the lifting surface comprises two half-surfaces for supporting the batches of products; the half-surfaces being movable independently of each other.

* * * * *